United States Patent [19]

Herrmann et al.

[11] Patent Number: 4,526,852

[45] Date of Patent: Jul. 2, 1985

[54] LIQUID DEVELOPER FOR DEVELOPING ELECTROSTATIC CHARGE IMAGES AND PROCESS FOR ITS PREPARATION

[75] Inventors: Heinz Herrmann; Hans-Joachim Schlosser, both of Wiesbaden, Fed. Rep. of Germany

[73] Assignee: Hoechst Aktiengesellschaft, Frankfurt am Main, Fed. Rep. of Germany

[21] Appl. No.: 562,013

[22] Filed: Dec. 16, 1983

[30] Foreign Application Priority Data

Dec. 24, 1982 [DE] Fed. Rep. of Germany ..... 3247925

[51] Int. Cl.[3] ..... G03G 9/12

[52] U.S. Cl. ..... 430/115; 430/137

[58] Field of Search ..... 430/110, 115

[56] References Cited

U.S. PATENT DOCUMENTS

| | | | |
|---|---|---|---|
| 3,542,682 | 11/1970 | Mutaffis | 430/115 |
| 3,992,342 | 11/1976 | Tsubuko et al. . | |
| 4,081,391 | 3/1978 | Tsubuko et al. | 430/114 |
| 4,243,736 | 1/1981 | Herrmann | 430/115 |
| 4,250,241 | 2/1981 | Tsubuko et al. | 430/114 |
| 4,306,009 | 12/1981 | Veillette et al. | 430/115 |
| 4,357,406 | 11/1982 | Kouchi et al. | 430/137 |
| 4,374,918 | 2/1983 | Veilette et al. | 430/115 |

FOREIGN PATENT DOCUMENTS

| | | | |
|---|---|---|---|
| 51-40465 | 11/1976 | Japan | 430/112 |
| 55-90959 | 7/1980 | Japan | 430/115 |

OTHER PUBLICATIONS

CRC Handbook of Chemistry and Physics—1982-1983; 63rd Edition Robert C. Weast, Ph.D.

*Primary Examiner*—Roland E. Martin

*Attorney, Agent, or Firm*—Schwartz, Jeffery, Schwaab, Mack, Blumenthal & Evans

[57] ABSTRACT

The invention relates to a liquid developer with negatively charged toner particles for developing electrostatic charge images. It is composed of a carrier liquid of high electric resistivity and low dielectric constant, pigments or dyes, a binder, a dispersing agent and a charge control agent, such as an N-vinylpyrrolidone-containing polymer, a waxy substance and conventional additives. The liquid developer additionally contains at least one wax which is readily soluble in the carrier liquid at increasing temperatures, but difficultly soluble at room temperature, which reduces the specific electric conductivity of the liquid developer and which has a softening point within a range of from about 50° to 120° C. and an acid number of from about 0 to 200.

13 Claims, No Drawings

LIQUID DEVELOPER FOR DEVELOPING ELECTROSTATIC CHARGE IMAGES AND PROCESS FOR ITS PREPARATION

BACKGROUND OF THE INVENTION

The present invention relates to a liquid developer containing negatively charged toner particles for developing electrostatic charge images, which comprises a carrier liquid of high electric resistivity and low dielectric constant, a pigment or dye, an N-vinylpyrrolidone-containing polymer, a waxy substance and conventional additives, and to a process for its preparation.

Liquid developers of this type are used in electrophotographic or electrographic copying processes in order to render latent electrostatic charge images visible. In principle, these developers are composed of colored particles which are dispersed in a solution of binder and charge control agent, in the carrier liquid, if required, together with a dispersing agent. The colored particles, with the charge control agent and the binder adhering thereto, are electrophoretically deposited in the electric field of the charge image. If an N-vinylpyrrolidone-containing polymer is present, the dispersing agent, binder and charge control agent may be identical.

It is known from German Offenlegungsschrift No. 27 40 870 (equivalent to U.S. Pat. No. 4,243,736) or from European Patent Application No. 0,037,475 to use waxes in amounts corresponding to the proportions of pigments in liquid developers which contain an N-vinylpyrrolidone-containing polymer as the binding and dispersing agent, and at the same time as the charge control agent. The waxes serve to improve the sedimentation properties of the liquid developer and the wipe-resistance of the developed images. Polyethylene wax is the wax employed. Minor amounts of halogenated paraffins can also be present. It has been shown, however, that full shade areas are made visible by these liquid developers, which do not yet satisfy highest performance demands.

Other printed publications, also, propose the addition of waxes to liquid developers. For example, a suspension developer is described in German Offenlegungsschrift No. 25 32 282 (equivalent to U.S. Pat. No. 3,992,342), which additionally contains polyethylene, polyethylene wax, and/or paraffin wax having a softening point of 60° C. to 130° C. By the admixture, the stability, sedimentation properties and viscosity of the liquid developer, the gloss and wipe-resistance of the copies obtained, and the degree of fouling of the apparatus are influenced. German Auslegeschrift No. 25 38 581 (equivalent to U.S. Pat. No. 4,081,391) and German Auslegeschrift No. 29 36 042 (equivalent to U.S. Pat. No. 4,250,241) also describe electrophotographic suspension developers which additionally contain a wax or polyolefin having a softening point of 60° C. to 130° C. The specific weight of these admixtures is similar to that of the carrier liquid. They are soluble in the heated liquid developer and separate off in the form of small particles during the cooling down phase.

German Offenlegungsschrift No. 30 46 654 (equivalent to U.S. Pat. No. 4,306,009) discloses a liquid developer which includes a special gelatex in addition to the customary components and may also contain a wax and a wood resin.

An examination of the respective descriptions shows, however, that only polyethylene, polyethylene wax or paraffin wax and beeswax are employed, such as, for example, a polyethylene having a softening point of 115° C. and a molecular weight of 1,500, low-molecular weight polyethylene having a softening point of 107° C. or 108° C., and paraffin waxes having softening points ranging between 60° C. and 110° C. It is possible to achieve high print runs with some of these liquid developers, but the copies obtained exhibit unsteady, non-homogeneously inked full shade areas. This is of particular disadvantage in cases where copying paper of low surface smoothness is used.

SUMMARY OF THE INVENTION

It is therefore an object of the present invention to provide an improved liquid developer.

It is also an object of the invention to provide a liquid developer which possesses the usual advantageous properties and in electrographic or electrophotographic copying processes yields copies exhibiting good surface coverage, even in cases where copying papers of low surface smoothness are used.

It is also an object of the invention to provide a process for producing the liquid developer according to the invention.

In accomplishing the foregoing objects, there has been provided in accordance with the present invention a liquid developer containing negatively charged toner particles for developing electrostatic charge images which comprises a carrier liquid of high electric resistivity and low dielectric constant; pigments or dyes, a N-vinylpyrrolidone-containing polymer; and at least one wax, which is readily soluble in the carrier liquid at rising temperatures, but difficulty soluble at room temperature, which reduces the specific electric conductivity of the liquid developer and which has a softening point within a range of from about 50° to 120° C. and an acid number of from about 0 to about 200.

In accordance with another aspect of the invention, there has been provided a process for the preparation of a liquid developer containing negatively charged toner particles for developing electrostatic images, comprising the steps of forming a paste of a carrier liquid of high electric resistivity and low dielectric constant, pigments or dyes, and an N-vinylpyrrolidone-containing polymer; grinding the paste of raw material at a temperature of from about 20° to 100° C.; forming a toner concentrate by diluting the ground material with additional carrier liquid or a solution of N-vinylpyrrolidone-containing polymer in the carrier liquid; diluting said toner concentrate with from about 5 to 20 times its quantity of carrier liquid; and adding either to the paste of raw material, to the ground material or the toner concentrate at least one wax, which is readily soluble in the carrier liquid at increasing temperatures, but difficulty soluble at room temperature, which reduces the specific electric conductivity of the liquid developer, and which has a softening point within a range of from about 50° to 120° C. and an acid number of from about 0 to 200.

Further objects, features and advantages of the present invention will become apparent from the detailed description of preferred embodiments which follows.

DETAILED DESCRIPTION OF PREFERRED EMBODIMENTS

The invention provides a liquid developer of the type desribed at the outset, which is characterized in that it contains at least one wax which is readily soluble in the carrier liquid at increasing temperatures, but difficultly soluble at room temperature, which reduces the specific electric conductivity of the liquid developer and which has a softening point within a range of between about 50° to 120° C. and an acid number of 0 to about 200.

Preferably there are used waxes by which the specific electric conductivity of the liquid developer is reduced by at least about 15% when 1% by weight of wax is added to a toner concentrate having a solids content of about 7% by weight.

The liquid developer of this invention preferably contains from about 0.1 to 1.5 parts by weight of wax per 1 part by weight of pigment or dye. This ensures that copies of better quality than copies obtained using customary liquid developers can be produced in conventionally used copiers. Full shade areas are developed more strongly and homogeneously. Even fine symbols are exactly reproduced on copying papers having a rough surface. Employing the liquid developer of this invention, it is possible to use quite simple, cheap copying paper.

The reason for the achieved effect is not yet known. It is, however, believed that by adding the wax of this invention the charge level of the toner particles is reduced and that, as a consequence thereof, an increased amount of toner and wax particles are deposited on the latent image, whereby a voluminous toner image which is rich in substances and which can be easily transferred to the copying paper is obtained. It is furthermore supposed that the wax contained in the moist, not yet fixed toner image is melted and/or redissolved in the remaining toner liquid during the fixing process. Thereby, the nonhomogeneous image areas are rendered homogeneous.

Waxes which can be used in accordance with the invention are those which meet the requirements concerning solubility (difficulty soluble, i.e., to more than about 95% insoluble at room temperature), the melting or softening range and the electrostatic chargeability of the toner particles or, respectively, the properties reducing the specific electric conductivity of the liquid developer. Most of these waxes are commercially available. They include the acid and ester waxes prepared on the basis of montan wax. Waxy substances, such as hydrated castor oil or polyoctadecene are also suitable. The waxes preferably have a softening point in a range of between about 60° and 90° C. The acid numbers of the waxes vary between 0 and about 200, preferably between about 0 and 160. Good results are also achieved with acid numbers of between about 10 and 160. It is also possible to use mixtures of several waxes or of waxes with polyethylene or paraffin wax. Waxes such as, for example, an ester wax having a softening point of between about 82° and 88° C., an acid number of between about 78 and 88 and a saponification number of between about 120 and 135 (1), an ester wax having a softening point of between about 76° and 82° C., an acid number of between about 15 and 20 and a saponification number of between about 125 and 155 (2), and an acid wax having a softening point of between about 78° and 84° C. and an acid number of between about 135 and 155 (3) can be advantageously used. Hydrated castor oil having a softening point of between about 86° and 88° C. and an acid number of 2 is also well suited, (4). Examples of further waxes which can be employed are listed in the table below.

TABLE I

| WAX No. | WAX TYPE | SOFTENING POINT °C. | ACID NUMBER |
|---|---|---|---|
| 5 | acid wax | 81–87 | 115–130 |
| 6 | acid wax | 78–84 | 115–130 |
| 7 | ester wax | 79–85 | 15–20 |
| 8 | ester wax | 78–86 | 15–30 |
| 9 | ester wax | 83–89 | 85–95 |
| 10 | ester wax | 79–85 | 25–35 |
| 11 | hydr. castor oil | 83–86 | 1.5 |
| 12 | hydr. castor oil | 86–88 | 3 |
| 13 | polyoctadecene | 70 | 0 |

When 1% of the waxes of the invention is added to a toner concentrate having a solids content of about 7% by weight, the specific electric conductivity of the liquid developer obtained is reduced by at least 15%. The reduction of the specific electric conductivity is a measure for the reduction of the charge level of the toner.

The conductivity-reducing action of a wax can be determined as follows: A hot solution of 2.5 g of wax in 30 ml of a liquid aliphatic hydrocarbon having a boiling range of between about 170° and 190° C. is stirred into 250 g of the toner concentrate described in Comparative Example 2. The mixture is allowed to rest for about 24 hours and is then diluted with 2 liters of the aliphatic hydrocarbon; subsequently the specific electric conductivity of the ready-for-use developer thus obtained is measured in a d.c. measuring cell, under the same conditions as a liquid developer not containing the wax admixture. Table II shows the values obtained using the waxes of this invention.

TABLE II

| Type or No. of wax | specific conductivity of liquid developer ($10^{-11}$ S/cm) | % reduction compared with wax-free liquid developer | Note according to the invention |
|---|---|---|---|
| without | 2.2 | — | — |
| Polyethylene wax, 103°–107° C. | 2.1 | 5 | unusable |
| Polyethylene wax. 119°–123° C. | 2.1 | 5 | unusable |
| Microparaffin wax, 58°–62° C. | 2.2 | 0 | unusable |
| Beeswax | 1.9 | 14 | unusable |
| Wax 4 | 1.82 | 18 | usable |
| Wax 2 | 1.70 | 23 | usable |
| Wax 1 | 1.45 | 34 | usable |
| Wax 8 | 1.45 | 34 | usable |
| Wax 10 | 1.30 | 41 | usable |
| Wax 9 | 1.28 | 42 | usable |
| Wax 3 | 1.05 | 52 | usable |
| Wax 6 | 1.03 | 53 | usable |

Suitable carrier liquids are, above all, the known aliphatic hydrocarbons having boiling points of between about 150° and 190° C., which are commonly used in liquid developers. Examples which shall be mentioned here, although they are by no means limiting, are petroleum distillation products (petroleum fractions) which are essentially odorless, relatively inexpensive and commercially available. These products include various hydrocarbon mixtures having about 8 to 16 carbon atoms. They possess a high electric resistivity of more than $10^9$ ohm·cm and a low dielectric constant of less than about 3.

The developer liquid must be capable of evaporating sufficiently quickly at evaporating temperatures which are lower than the temperature at which the copying paper gets charred. Preferably, the developer liquid does not contain aromatic liquids or other components which have an extraordinarily toxic or corroding action. The developer liquid further has a sufficiently low viscosity to allow for a rapid migration of the particles which are attracted by the electrostatically charged image areas to be developed. The viscosity of the carrier liquid at room temperature varies between about 0.5 and 2.5 mPa·s.

The pigments used in accordance with the invention are known. As a rule, synthetic carbon blacks are employed to produce black developers. For toning the hue, blue pigments can, for example, be added to the carbon blacks.

Principally, all organic and inorganic pigments and dyes can be used. Examples of them are: Carbon Black (C.I. No. 77 266), Oil Blue (C.I. No. 61 555), Alkali Blue (C.I. No. 42 750), Phthalocyanine Blue (C.I. No. 74 160), Phthalocyanine Green (C.I. No. 74 260 or 42 040), Spirit Black (C.I. No. 50 415), Oil Violet (C.I. No. 60 725), Benzidine Yellow (C.I. No. 21 090 or 21 100), Methyl Orange (C.I. No. 13 025), Brilliant Carmine (C.I. No. 15 850) or Fast Red (C.I. No. 15 865).

Polymers which contain N-vinylpyrrolidone and are soluble in aliphatic solvents are used to produce a negative charge on the pigment particles. These include copolymers comprised of a solubility-imparting methacrylic acid ester possessing an alkyl group with 6 or more carbon atoms and 15 to 40% of N-vinylpyrrolidone-2 or graft polymers which are obtained by grafting 2.5 to 10% by weight of N-vinylpyrrolidone-2 on soluble homopolymers or copolymers of methacrylic acid esters. It is also possible to use other known negative control agents, such as, for example, phospholipoids, such as lecithin, or metal salts of organic sulfonic acids, which are soluble in aliphatic compounds, such as, for example, the sodium salt of dioctylsulfosuccinic acid. The simultaneous use of several control agents is also possible.

By the optional additives, various toner properties can be influenced, such as charge level, sedimentation properties, useful life, redispersibility of agglomerates, transferability and wipe-resistance on the copying paper.

Conventional additives which can be added on a case-by-case basis are:

(a) halogen-containing waxes, for example, chloroparaffin having a chlorine content of 70%, (b) polymers which are soluble in the carrier liquid, such as a styrene/butadiene copolymer, polyvinyl alkyl ethers, polyisobutylenes, polyvinyl stearate and polyacrylates or polymethacrylates with a higher alcohol radical, (c) resins which are soluble in the carrier liquid, such as hydrocarbon resins and polyterpene resins, (d) plasticizers, such as dialkyl phthalates.

The amount of waxes according to the present invention contained in the liquid developer may vary widely. Preferably, from about 0.1 to 1.5, and in particular from about 0.3 to 0.8 parts by weight of wax are added per 1 part by weight of pigment.

The weight ratio of polymer to colorant is not very critical. Usually, from about 0.2 to 3 parts by weight of polymer are employed per 1 part of colorant, i.e., pigment or dye.

The present invention also relates to a process for preparing the liquid developer.

In the preparation of the liquid developer, care has to be taken that the wax of the invention is dissolved in the carrier liquid by heating during any of the various stages of the preparation process. On cooling down, the wax then flocculates into fine particles or microcrystalline structures having a size of between about 0.1 and a few 10 microns.

In general, the wax is already added to the paste of raw material, in order to avoid an additional process stage in the preparation of the liquid developer. For this purpose, wax powder or a wax dispersion obtained by dissolving the wax in hot carrier liquid and cooling down the solution can be used. While the paste of raw material is being ground, the grinding stock must be heated to such a temperature that the wax is dissolved.

The process of this invention for the preparation of a liquid developer containing negatively charged toner particles for developing electrostatic charge images, from a carrier liquid of high electric resistivity and low dielectric constant, pigments or dyes, an N-vinylpyrrolidone-containing polymer, a waxy substance and conventional admixtures, comprises the steps of forming a paste of the pigments or dyes, the N-vinylpyrrolidone-containing polymer and the other additives in the carrier liquid, grinding the paste of raw material at temperatures of from about 20° to 100° C., diluting the ground material with carrier liquid in which N-vinylpyrrolidone-containing polymer may be dissolved, whereby a toner concentrate is obtained, and diluting said toner concentrate with 5 to 20 times its quantity of carrier liquid, said process being characterized in that at least one wax, which is easily soluble in the carrier liquid at increasing temperatures, but difficultly soluble at room temperature, which reduces the specific electric conductivity of the liquid developer, and which has a softening point within a range of from about 50° to 120° C. and an acid number of 0 to about 200, is added either to the paste of raw material, to the ground material or to the toner concentrate. Preferably, the wax is added to the paste of raw material in the form of finely divided solid particles or is dispersed in the carried liquid.

Another process for the preparation of the liquid developer is characterized in that the wax is added to the toner concentrate in the form of a hot solution while agitating.

Three-roll mills, attrition mills, ball mills, ball mill agitators, and the like, are suitable for dispersing the paste of raw material. For diluting the ground material, propeller mixers, laboratory dissolvers or high-speed agitators are used.

Below, the invention is explained in greater detail by way of the following, non-limiting examples.

COMPARATIVE EXAMPLE 1

(a) Preparation of the toner concentrate (according to the teaching of German Offenlegungsschrift No. 30 11 193 corresponding to European Patent Application No. 0 037 475)

A paste was formed of 60 g of carbon black 18 g of copper phthalocyanine and 24 g of powdery polyethylene wax having a mean molecular weight of 1,500, in 200 g of a commercially available 20% strength solution of a graft polymer which was obtained by grafting 4 parts by weight of N-vinylpyrrolidone-2 on 96 parts by weight of a dodecyl methacrylate/methyl methacrylate copolymer (76:20) having a mean molecular weight of about 450,000 and being dissolved in an aliphatic hydrocarbon having a boiling range of 170° to 190° C., and 420 g of the aliphatic hydrocarbon, having a boiling range of 170° to 190° C.

The paste of raw material was ground for 3 hours in a pearlmill at 80° C. and diluted with a mixture of 200 g of the above-described 20% strength graft polymer solution and 1,900 g of the above-mentioned hydrocarbon.

(b) Preparation of the liquid developer

The toner concentrate prepared as described in (a) was diluted with about 9 times as much of an aliphatic hydrocarbon having a boiling range of 160° to 180° C.

A liquid developer yielding good copies and having a long useful life, and including negatively charged toner particles, was obtained. However, the full shade areas were inked nonhomogeneously.

EXAMPLES 1 TO 4

10 g of wax (as indicated in Table 3) were each dissolved in 150 g of an aliphatic hydrocarbon, boiling range 170° to 190° C., at temperatures between about 50° and 80° C. Then the warm solutions were slowly added to 500 g each of the toner concentrate prepared according to Comparative Example 1, while agitating intensely by means of a laboratory dissolver. Subsequently, the mixtures were stirred for another 2½ minutes.

The mixtures were diluted with about 9 times as much of an aliphatic hydrocarbon, boiling range 160° to 180° C., and ready-for-use liquid developers were obtained. The results achieved using these developers in a conventional copying apparatus are compiled in Table III.

TABLE III

| Liquid developer acc. to Example No. | wax | Inking grade of full shade areas |
|---|---|---|
| 1 | microparaffin | nonhomogeneous |
| 2 | hydr. castor oil, softening point (S.P.) 86 to 88° C. | homogeneous |
| 3 | ester wax S.P. 76 to 82° C. | homogeneous |
| 4 | acid wax S.P. 78 to 84° C. | homogeneous |

EXAMPLE 5

30 g of an ester wax, softening point 82° to 88° C., and 4 g of chloroparaffin (chlorine portion 70%) were dissolved in a warm mixture of 420 g of an aliphatic hydrocarbon, boiling range 170° to 180° C., and 200 g of the N-vinylpyrrolidone copolymer solution of Comparative Example 1, and the solution was subsequently cooled down. 60 g of carbon black and 18 g of copper phthalocyanine were added to the resulting wax dispersion. The paste of raw material was ground as described in Comparative Example 1 and diluted into a toner concentrate with 300 g of the copolymer solution mentioned above and 1,900 g of the aliphatic hydrocarbon.

The toner concentrate was then diluted with seven times its quantity of an aliphatic hydrocarbon, boiling range 160° to 180° C., so that a ready-for-use liquid developer was obtained, which is a conventional copying apparatus gave copies which were rich in contrast and exhibited excellent, homogeneous full shade areas.

Even when paper intended for dry developing was used, which normally is unsuitable for developing with liquid toner, good copies were obtained.

EXAMPLE 6

Example 5 was repeated, with the exception that an acid wax having a softening point of between about 78° and 84° C. and an acid number of 135 to 155 was employed.

The toner concentrate was additionally stirred with a high-speed mixer.

A test in a copying apparatus resulted in similarly good copies as in Example 5.

EXAMPLE 7

Example 5 was repeated, using a polyoctadecene wax having a melt viscosity (140° C.) of 605 mPa·s.

Using this toner in a conventional copying apparatus, copies exhibiting excellent full shade areas were obtained, even on rough copying papers.

EXAMPLE 8

A paste of raw material composed of 60 g of carbon black, 20 g of copper phthalocyanine, 50 g of an ester wax, softening point 82° to 88° C., acid number 78 to 88, 4 g of chloroparaffin, 200 g of the graft polymer solution described in Comparative Example 1, and 420 g of an aliphatic hydrocarbon, boiling range 170° to 190° C., was ground as indicated in Comparative Example 1. The toner concentrate obtained by diluting the paste with 300 g of the graft polymer solution and 1,900 g of the hydrocarbon was additionally stirred with a high-speed mixer.

A liquid developer, which was suitable for use in a conventional copying apparatus was prepared by mixing with 6.5 times the quantity of the aliphatic hydrocarbon and then tested. Copies with excellent full shade areas were obtained.

EXAMPLE 9

Example 8 was repeated using the following paste of raw material:

60 g of carbon black, 24 g of copper phthalocyanine, 30 g of the ester wax described in Example 8, 10 g of polyethylene wax (S.P. 103° to 107° C.)

4 g of chloroparaffin, 200 g of the copolymer solution of Comparative Example 1, and 420 g of an aliphatic hydrocarbon, boiling range 170° to 190° C.

After diluting as indicated in Example 8, a liquid developer was obtained, which was used in a conventional copying apparatus. The resulting copies exhibited excellent, homogeneous image areas.

EXAMPLE 10

A paste of raw material comprising 60 g of carbon black, 18 g of copper phthalocyanine, 40 g of polyoctadecene, melt viscosity (140° C.), 960 mPa·s, 200 g of the copolymer solution of Comparative Example 1, and 420 g of an aliphatic hydrocarbon, boiling range 170° to 190° C., was ground as described in Comparative Example 1.

750 g of the ground material were diluted, while strongly stirring with a laboratory dissolver, with a mixture of 600 g of an aliphatic hydrocarbon, boiling range in the range of 160° to 180° C., and 210 g of the copolymer solution described in Comparative Example 1.

The resulting toner concentrate was diluted into a ready-for-use liquid developer by adding 6 times the quantity of an aliphatic hydrocarbon boiling in the range of 160° to 180° C. In a conventional copying apparatus, copies of excellent quality were obtained, even when dry toner copying paper was used.

EXAMPLES 11 TO 20

A paste of raw material comprising 60 g of carbon black, 18 g of copper phthalocyanine, 8 g of chloroparaffin, 200 g of the copolymer solution described in Comparative Example 1, and 420 g of an aliphatic hydrocarbon, boiling range 170° to 190° C., was ground as indicated in Comparative Example 1. 140 g portions of the ground material were each diluted with a mixture of 72 g of the copolymer solution of Example 1 and 350 g of an aliphatic hydrocarbon having a boiling range of 170° to 190° C., and subsequently, a hot solution of 8 g of wax (as described in Table IV) in 75 g of the aliphatic hydrocarbon was added while strongly stirring with a laboratory dissolver.

The liquid developers obtained by diluting with 8 times the quantity of hydrocarbon, boiling range 160° to 180° C., led to the following results:

TABLE IV

| Liquid developer acc. to Example | Wax | Inking grade of full shade areas |
|---|---|---|
| 11 (Comparison) | Polyethylene wax | nonhomogeneous |
| 12 | Ester wax, S.P. 79°-85° C. | very homogeneous |
| 13 | Ester wax, S.P. 76°-82° C. | homogeneous |
| 14 | Ester wax, S.P. 83°-89° C. | rather homogeneous |
| 15 | Acid wax, S.P. 78°-84° C. | rather homogeneous |
| 16 | Acid wax, S.P. 81°-87° C. | rather homogeneous |
| 17 | Ester wax, S.P. 82°-88° C. | rather homogeneous |
| 18 | Ester wax, S.P. 78°-86° C. | homogeneous |
| 19 | hydrated castor oil, S.P. 86°-88° C. | homogeneous |
| 20 (Comparison) | Beeswax | nonhomogeneous |

COMPARATIVE EXAMPLE 2

A paste of raw material, comprising 60 g of carbon black, 18 g of copper phthalocyanine, 200 g of the graft polymer solution described in Example 1, and 420 g of an aliphatic hydrocarbon, boiling range 170° to 190° C., was ground as described in Comparative Example 1.

The ground material was diluted into a toner concentrate with a mixture of 380 g of the above graft polymer solution and 1,160 g of the aliphatic hydrocarbon.

By diluting with 7 times the quantity of an aliphatic hydrocarbon, boiling range 160° to 180° C., a liquid developer was obtained which resulted in copies with nonhomogeneously inked full shade areas.

EXAMPLES 21 TO 32

A solution of 2.5 g wax in 22.5 g of a hot aliphatic hydrocarbon, boiling range 170° to 190° C., was slowly poured into 230 g of the toner concentrate prepared in accordance with Comparative Example 2, while strongly agitating by means of a laboratory dissolver. After the addition was completed, the mixture was thoroughly stirred for another 5 minutes.

Ready-for-use liquid dissolvers were obtained by diluting the concentrates with 7 times as much of an aliphatic hydrocarbon, boiling range 160° to 180° C. Tests of the liquid developers in a conventional copying apparatus led to the results compiled in Table V.

TABLE V

| Example No. | Wax | Inking grade of full shade areas |
|---|---|---|
| 21 | Polyethylene wax S.P. 103° to 107° C. | nonhomogeneous |
| 22 | Polyethylene wax S.P. 119° to 123° C. | nonhomogeneous |
| 23 | Microparaffin S.P. 58° to 62° C. | nonhomogeneous |
| 24 | Beeswax | nonhomogeneous |
| 25 | Hydr. castor oil, S.P. 86° to 88° C. | rather homogeneous |
| 26 | Acid wax, S.P. 78° to 84° C. | homogeneous |
| 27 | Ester wax, S.P. 82° to 88° C. | homogeneous |
| 28 | Ester wax, S.P. 76° to 82° C. | homogeneous |
| 29 | Ester wax. S.P. 78° to 86° C. | homogeneous |
| 30 | Ester wax, S.P. 83° to 89° C. | very homogeneous |
| 31 | Acid wax, S.P. 81° to 87° C. | very homogeneous |
| 32 | Ester wax S.P. 79° to 85° C. | very homogeneous |

What is claimed is:

1. A liquid developer containing negatively charged toner particles for developing electrostatic charge images, which comprises:

a carrier liquid of high electric resistivity and low dielectric constant;

pigments or dyes;

a N-vinylpyrrolidone-containing polymer; and at least one wax which is readily soluble in said carrier liquid at increasing temperatures, but difficultly soluble a room temperature in aliphatic hydrocarbon carrier liquids, which reduces the specific electric conductivity of the liquid developer and which has a softening point within a range of from about 50° to 120° C. and an acid number of from about 0 to about 200, said wax (i) being an acid or ester wax derived from montan wax, hydrated castor oil or polyoctadecene, and (ii) being present in said carrier liquid as fine particles or microcrystalline structures having a size of between about 0.1 and a few tens of microns.

2. A liquid developer as claimed in claim 1, wherein the wax reduces the specific electric conductivity of said liquid developer by at least about 15%, when 1% by weight of wax is added to the toner concentrate having a solids content of about 7% by weight.

3. A liquid developer as claimed in claim 1, wherein the wax has a softening point within a range of from about 60° to 90° C.

4. A liquid developer as claimed in claim 1, wherein the wax has an acid number of from about 0 to 160.

5. A liquid developer as claimed in claim 1, wherein the wax has an acid number of from about 10 to 160.

6. A liquid developer as claimed in claim 1, wherein between about 0.1 and 1.5 parts by weight of wax are contained per 1 part by weight of pigment or dye.

7. A liquid developer as claimed in claim 1, wherein the wax comprises an ester wax which is derived from montan wax and has a softening point within a range of from about 82° to 88° C., an acid number of from 78 to 88, and a saponification number of from about 120 to 135.

8. A liquid developer as claimed in claim 1, wherein the wax comprises an ester wax which is derived from montan wax and has a softening point within a range of from about 76° to 82° C., an acid number of from about 15 to 20, and a saponification number of from about 125 to 155.

9. A liquid developer as claimed in claim 1, wherein the wax comprises an ester wax which is derived from montan wax and has a softening point within a range of from about 78° to 86° C., an acid number of from about 15 to 30 and a saponification number of from about 130 to 150.

10. A liquid developer as claimed in claim 1, wherein the wax comprises an acid wax which is derived from montan wax and has a softening point within a range of from about 78° to 84° C. and an acid number of from about 135 to 155.

11. A liquid developer as claimed in claim 1, wherein the wax comprises a hydrated castor oil which has a softening point of from about 86° to 88° C. and an acid number of about 2.

12. A liquid developer as claimed in claim 1, wherein the wax comprises a polyoctadecene which has a softening point of about 70° C. and an acid number of 0.

13. A liquid developer as claimed in claim 1, wherein said wax is readily soluble in said carrier liquid at a temperature between about 50° and 80° C.

* * * * *